US008602821B2

(12) United States Patent
Fujisaki

(10) Patent No.: US 8,602,821 B2
(45) Date of Patent: Dec. 10, 2013

(54) ELECTRICAL CONNECTOR HAVING AN ELECTRONIC DEVICE

(75) Inventor: Ryuichi Fujisaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 9 days.

(21) Appl. No.: 13/457,807

(22) Filed: Apr. 27, 2012

(65) Prior Publication Data

US 2012/0289087 A1 Nov. 15, 2012

(30) Foreign Application Priority Data

May 11, 2011 (JP) ..... 2011-106453

(51) Int. Cl.
*H01R 13/58* (2006.01)

(52) U.S. Cl.
USPC ..... 439/606; 439/620.09; 439/620.21

(58) Field of Classification Search
USPC ..... 439/606, 620.09, 620.12, 620.13, 439/620.21
See application file for complete search history.

(56) References Cited

U.S. PATENT DOCUMENTS 4,647,138 A 3/1987 Muz
5,458,508 A * 10/1995 Sawada ..... 439/620.21
5,577,937 A * 11/1996 Itoh et al. ..... 439/620.22
6,010,366 A * 1/2000 Tanigawa et al. ..... 439/620.09
7,588,466 B2 * 9/2009 Blasko et al. ..... 439/620.09
2004/0002260 A1 * 1/2004 Okamoto ..... 439/606
2006/0030216 A1 * 2/2006 Horiba ..... 439/620

FOREIGN PATENT DOCUMENTS

JP 03187170 8/1991
JP 2006-173414 6/2006
JP 2006173414 6/2006

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A connector (10) has a capacitor (20) connected to a ground-side terminal (32) formed by press-working a metal base material in the form of a flat plate and is accommodated in a housing (50) made of synthetic resin. A connecting head (38) is provided on the ground-side terminal (32) and is thinner than the base material. The connecting head (38) is connected to a ground-side electrode (21B) provided on the capacitor (20) by soldering. A resiliently deformable neck (39) on the ground-side terminal (32) is narrower than the connecting head (38) and extends from the connecting head (38). A molded portion (53) is provided in the housing (50) to integrally cover the ground-side electrode (21B) of the capacitor (20) and the connecting head (38) of the ground-side terminal (32).

11 Claims, 6 Drawing Sheets

ELECTRICAL CONNECTOR HAVING AN ELECTRONIC DEVICE

BACKGROUND OF THE INVENTION

1. Field of the Invention

The present invention relates to a connector with a built-in electronic device.

2. Description of the Related Art

Japanese Unexamined Patent Publication No. 2006-173414 discloses a connector with a built-in capacitor as an electronic device. This connector is used to dispose a noise preventing capacitor at an intermediate position of a power supply line in the case of sharing a defogger equipped for a rear window of a vehicle with an antenna of a radio or the like. The connector includes two terminal fittings connected to two electrodes provided at both ends of the capacitor. A connector housing made of synthetic resin accommodates the capacitor and both terminal fittings. For example, this connector grounds the defogger to a body panel of the vehicle via the capacitor by connecting one terminal fitting to the defogger of the vehicle and bolting the other terminal fitting to the body panel. Thus, noise produced when a switch of the defogger is turned on and off is suppressed.

The electrode of the capacitor and a connecting portion provided on the terminal fitting are connected, for example, by bringing the tip of a soldering iron into contact with the connecting portion to heat the connecting portion and pressing solder against the connecting portion to melt the solder for soldering.

Lead-free solder has been used widely in recent years in view of environmental considerations. Lead-free solder has a higher melting point than lead-containing solder and is more difficult to melt. Thus, unless the capacitor is sufficiently heated, the electrode and the connecting portion are connected by solder that is not completely melted and voids are formed in the solder. A sudden temperature change given to a soldered part, such as in a heat shock test, causes stress and can create a crack in the soldered part due to the voids. Thus, connection reliability between the electrode and the connecting portion is reduced.

Extending a heating time for the connecting portion and sufficiently heating the connecting portion may completely melt the solder and suppress the formation of voids. However an electronic device, such as a capacitor held in contact with the connecting portion, also would be heated for a long time and may be damaged by heat.

The invention was completed in view of the above situation and an object thereof is to ensure connection reliability between an electronic device and a terminal fitting without damaging the electronic device by heat.

SUMMARY OF THE INVENTION

The invention relates to a connector with a terminal fitting formed by press-working a metal base material in the form of a flat plate and an electronic device connected to the terminal fitting. The terminal fitting and the electronic device are accommodated in a housing made of synthetic resin. The terminal fitting has a connecting head that is thinner than the base material. The connecting head is to be connected to an electrode on the electronic device by soldering. At least one neck is provided on the terminal fitting and is narrower than the connecting head. The neck is resiliently deformable and extends from the connecting head. A molded portion is provided in the housing for integrally covering at least part of the electrode of the electronic device and the connecting head of the terminal fitting.

To connect the connecting head of the terminal fitting and the electrode of the electronic device, for example, the tip of a soldering iron is brought into contact with a part of the connecting head opposite to a part to be soldered to heat the connecting head and solder is pressed against the connecting head to melt the solder. Thus, the connecting head and the electrode are connected by soldering. Further, according to Fourier's law, the quantity of heat $\Delta Q$ [J] moving in a section ($L \times A$ [$m^3$]) having a thickness L [m] and a cross-sectional area A [$m^2$] can be expressed by $\Delta Q=(k \times A \times \Delta T \times t)$ when k [W/mk], $\Delta t$ [K] and t [s] denote thermal conductivity, temperature difference and time. That is, the quantity of heat $\Delta Q$ moving in an object can be increased by reducing the thickness L and can be reduced by reducing the cross-sectional area A.

Thus, according to the above configuration, the temperature of the soldered part of the connecting head can be increased in a short time since the connecting head is thinner than the base material and the quantity of heat transferring in the connecting head is larger than that in a connecting head that is not thinned.

Further, by making the neck narrower than the connector mounting portion, the cross-sectional area of the neck is smaller than that of the connecting head and the quantity of heat transferring in the neck per unit time is less as compared with a wide neck. Thus, radiation of the heat of the connecting head via the neck can be reduced. As described above, the connecting head can be heated sufficiently without extending a heating time for the connecting head and the escape of the heat of the connecting head can be reduced. Thus, the electrode and the connecting head can be connected by soldering by sufficiently melting the solder without forming voids in the solder. In this way, connection reliability between the electronic device and the terminal fitting can be ensured without damaging the electronic device by heat.

If heating and cooling are performed on the connector such as in a heat shock test, the molded portion thermally expands and shrinks more than the terminal fitting and the solder due to a difference in linear expansion coefficient between metal and resin. Thus, stress associated with the deformation of the molded portion concentrates on the connecting head and the electrode covered by the molded portion and the solder may be cracked or broken. In this respect, since the neck can be deformed resiliently according to the deformation of the molded portion according to the above configuration, it is possible to suppress the concentration of stress on the solder and the formation of a crack, a split or the like in the solder.

The connecting head may be such that a surface to be connected to the electrode of the electronic device is hammered to be larger than before it is hammered. Accordingly, the area of the connecting head to be connected to the electrode can be increased as compared with the case where the connecting head is in the form of a projection or has an uneven shape. Thus, the electrode and the connecting head portion can be connected more reliably and connection reliability between the electrode and the connecting head is more reliable.

The connecting head portion may be substantially in the form of a round flat plate. Accordingly, a force received from the molded portion by the connecting head (force trying to resiliently deform the connecting head, such as in a heat shock test, can be distributed over the entire connecting head portion without being concentrated on a specific position. Thus, the formation of a crack, a split or the like in the solder attached to the connecting head can be suppressed as compared with the case where the connecting head has a rectangular shape including corners.

The electronic device may be or comprise a capacitor and the terminal fitting may include a ground-side terminal made of iron with one end connected to a grounding part and the other end connected to the capacitor. The connecting head may be formed on the ground-side terminal. According to this configuration, even in the ground-side terminal made of iron having lower thermal conductivity than copper, the connecting head can be sufficiently heated without extending the heating time for the connecting portion head portion. Thus, the electrode of the capacitor and the connecting head portion can be connected by soldering without forming voids in the holder.

A cross-sectional area of the neck preferably is smaller than that of the connecting head.

The connecting head is formed to be gradually thinner in an extending direction thereof, and wherein a surface of the connecting head substantially opposite to a connecting surface thereof to the electrode is inclined toward the connecting surface.

A substantially central part of the neck in the extending direction preferably is hammered at rear corners located on both lateral sides, thereby defining a substantially flat semicircular cross section An intermediate part of the neck in the extending direction preferably is narrower than upper and/or lower end parts of the neck.

A cross-sectional area of the neck preferably is about half or less than that of a lower end part of the connecting head.

A connecting surface of the connecting portion to be connected to the electrode of the capacitor particularly is formed to be substantially flush with a corresponding surface of the neck.

These and other objects, features and advantages of the present invention will become more apparent upon reading of the following detailed description of preferred embodiments and accompanying drawings.

DETAILED DESCRIPTION OF THE PREFERRED EMBODIMENTS

A connector in accordance with the illustrated embodiment of the invention is identified by the numeral 10 and has a built-in capacitor 20 as an electric or electronic device.

This connector 10 is provided for suppressing noise produced e.g. when a switch of an unillustrated defogger in a vehicle is turned on and off by grounding the defogger via the capacitor.

Figure 7:
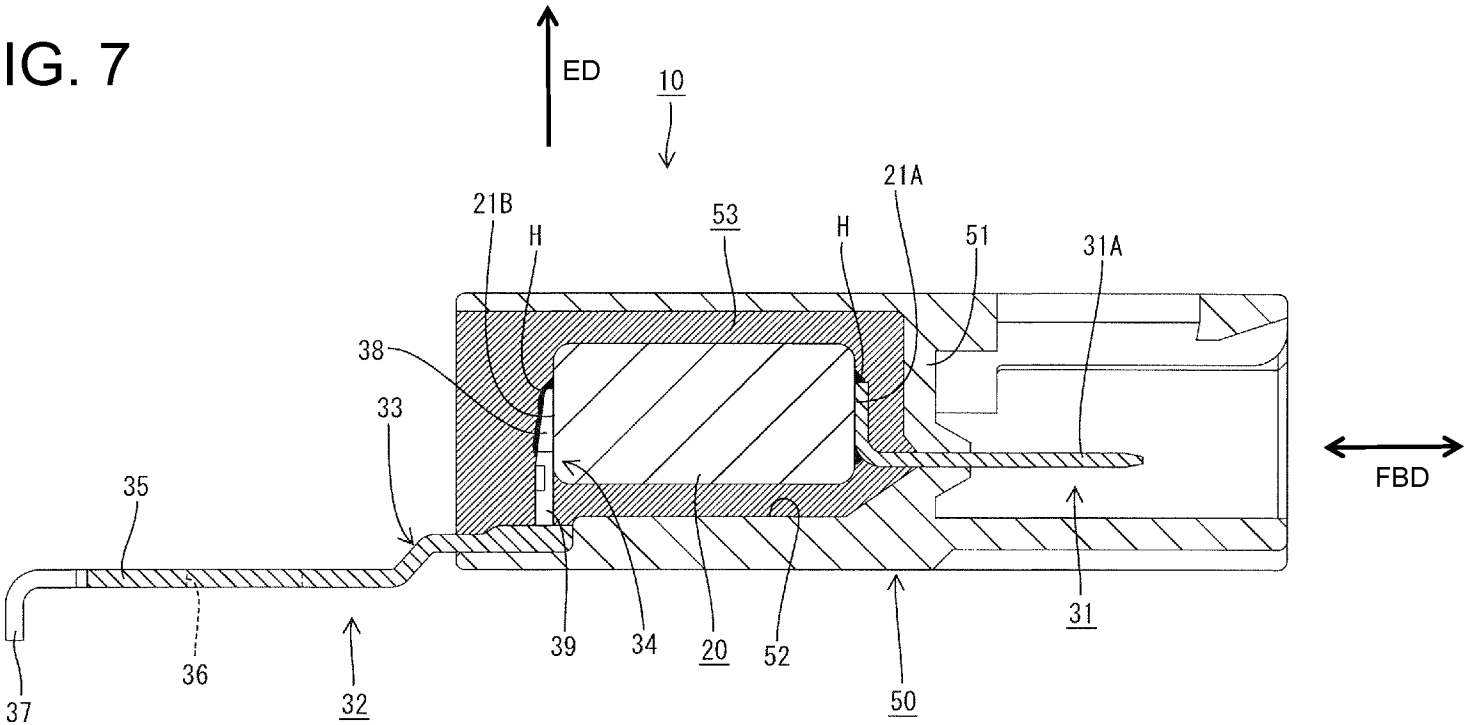
FIG. 7 is a section showing a state where the ground-side terminal and the wire-side terminal connected to the capacitor are mounted in a connector housing.

As shown in FIG. 7, the connector 10 includes the capacitor 20 extending in substantially forward and backward directions FBD, a wire-side terminal 31 to be connected to a wire-side electrode 21A on the front end of the capacitor 20, a ground-side terminal 32 to be connected to a ground-side electrode 21B on the rear end of the capacitor 20, a housing 50 made e.g. of synthetic resin and capable of accommodating the capacitor 20, and a molded portion 53 integrally covering the capacitor 20 connected to the wire-side terminal 31 and the ground-side terminal 32. Note that solder H is not shown in FIG. 5 to make connected parts of the capacitor 20 to the wire-side terminal 31 and the ground-side terminal 32 easily visible.

Figure 5:
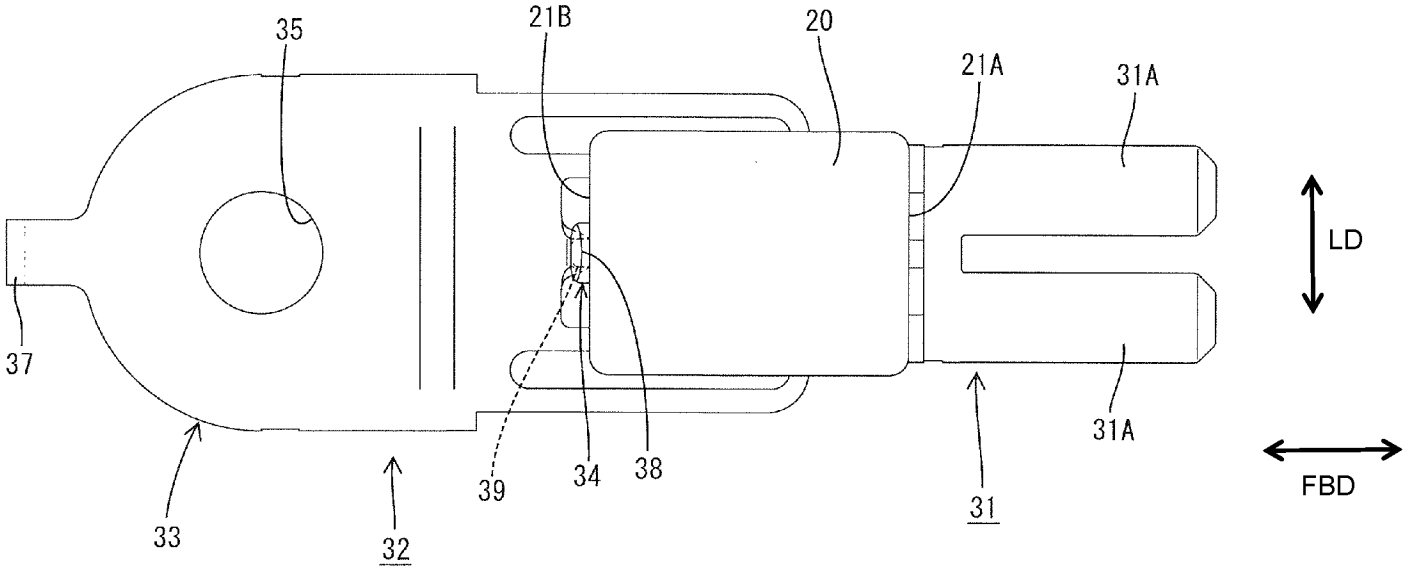
FIG. 5 is a plan view showing a state where the ground-side terminal and a wire-side terminal are connected to a capacitor.
Figure 6:
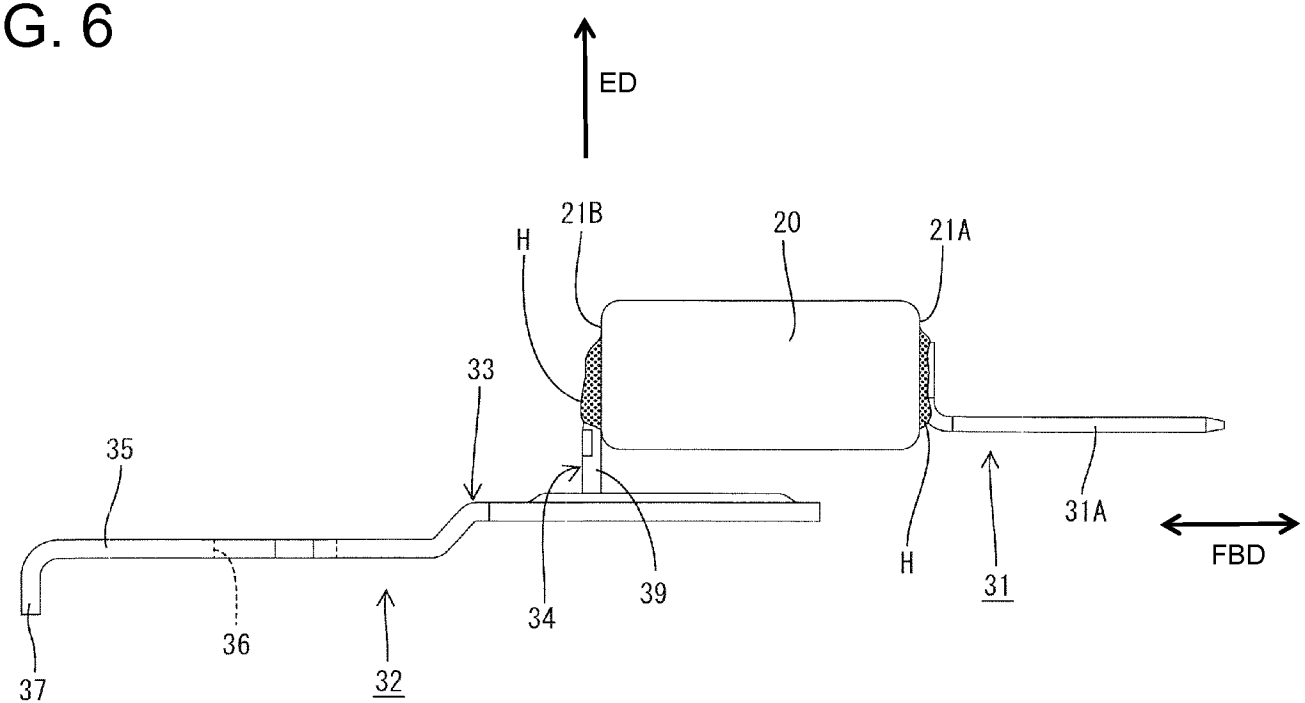
FIG. 6 is a side view showing the state of FIG. 5.

As shown in FIGS. 5 and 6, the capacitor 20 is a film capacitor having a substantially cylindrical shape extending in substantially forward and backward directions FBD and wrapped by an evaporated film for capacitor. The wire-side electrode 21A and the ground-side electrode 21B at the front and rear ends of the capacitor 20 are formed to have a substantially flat surface by thermally spraying a metal.

As shown in FIGS. 6 and 7, the wire-side terminal 31 particularly is formed by bending a conductive plate, such as a copper or copper alloy flat plate, substantially in an L shape. As shown in FIG. 5, two tabs 31A juxtaposed in a lateral direction LD are formed at a front portion of the wire-side terminal 31. The tabs 31A are inserted into unillustrated male terminal fittings provided in an unillustrated mating connector connected to an electrical/electric equipment, such as the defogger to be connected electrically conductively to the female terminal fittings when the mating connector and the connector 10 are connected.

As shown in FIGS. 6 and 7, a rear end portion of the wire-side terminal 31 is connected electrically conductively to the wire-side electrode 21A of the capacitor 20 by soldering. Note that, in this embodiment, lead-free solder H containing no lead is used due to environmental considerations.

Figure 1:
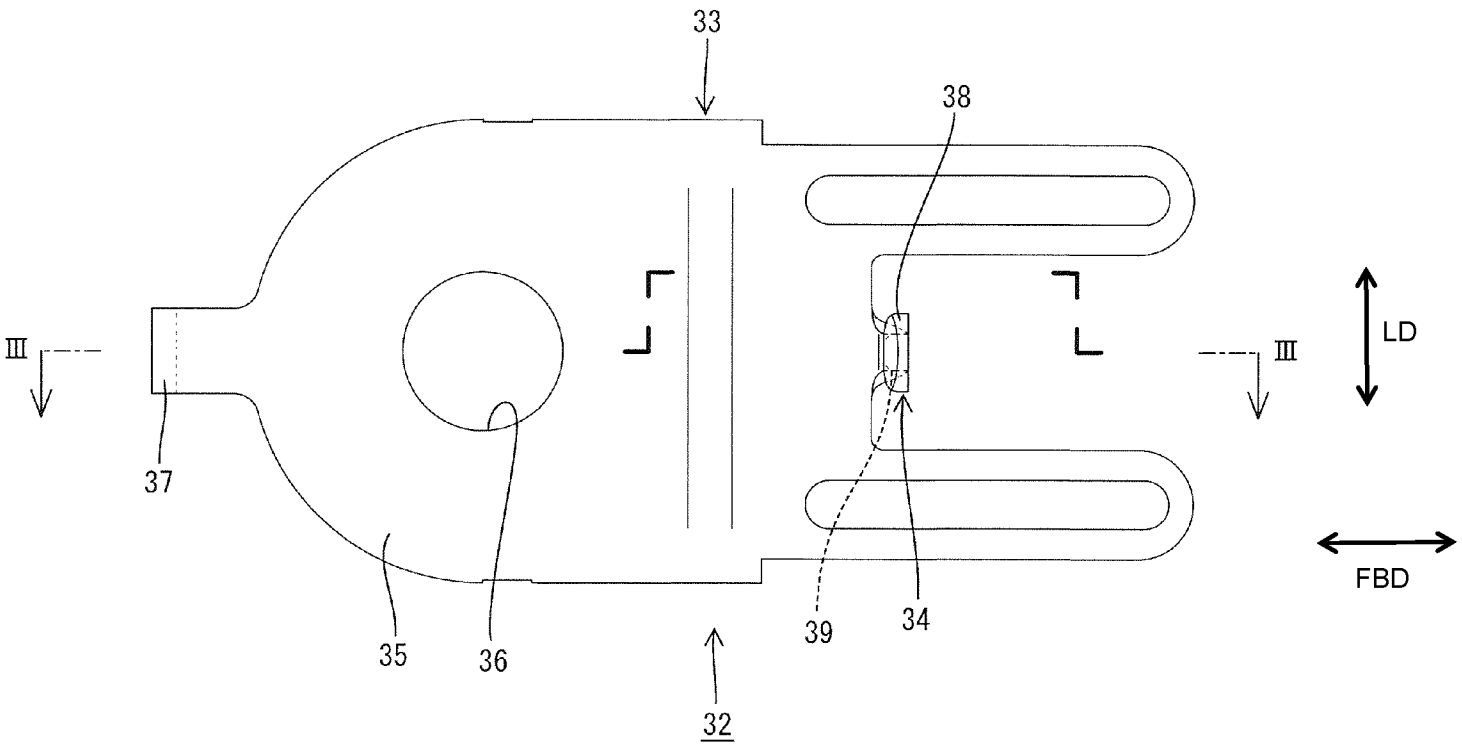
FIG. 1 is a plan view of a ground-side terminal.
Figure 2:
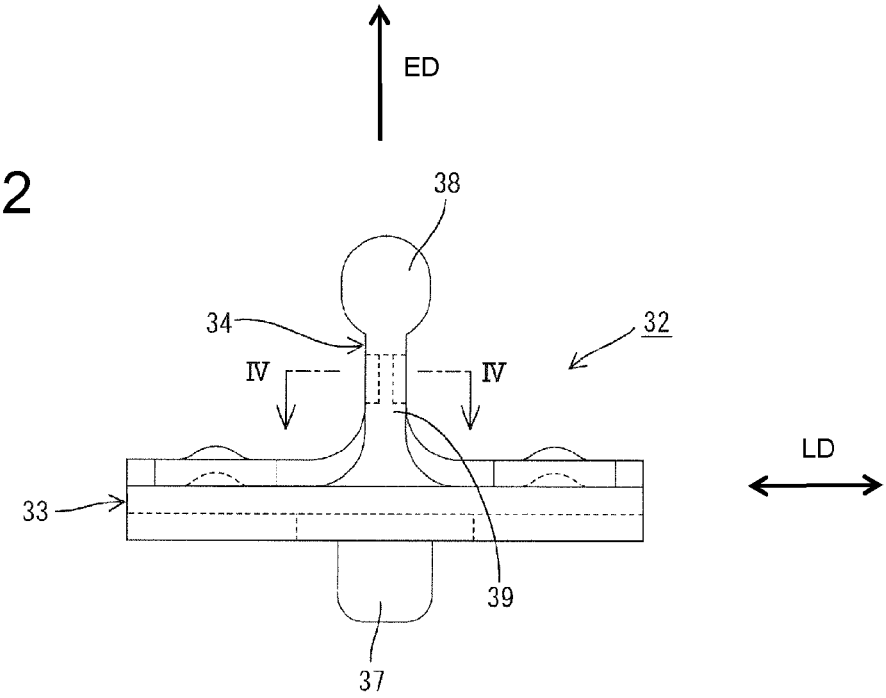
FIG. 2 is a front view of the ground-side terminal.

The ground-side terminal 32 is formed by press-working a base material in the form of a flat plate made of an electrically conductive material (such as cold-rolled steel plate, SPC steel plate) and bending a pressed piece. Thus, the ground-side terminal has a terminal main body 33 substantially in the form of a flat plate extending in forward and backward directions FBD and a capacitor mounting portion 34 is arranged to stand substantially perpendicularly up from the terminal main body 33, as shown in FIGS. 1 to 3.

A fixing portion 35 is formed at a part of the terminal main body 33 behind a substantially central part in forward and backward directions FBD and is to be fixed to the unillustrated body panel of the vehicle. A bolt insertion hole 36 vertically penetrates the fixing portion 35. An unillustrated fixing bolt is inserted into the bolt insertion hole 36 and tightened into the body panel to connect the fixing portion 35 electrically conductively to the body panel so that the ground-side terminal 32 is grounded to the body panel.

A locking piece 37 is provided at a rear end part of the fixing portion 35 and is bent substantially perpendicularly down. The locking piece 37 is inserted into an unillustrated locking hole in the body panel and engages the inner surface of the locking hole when the fixing portion 35 is bolted to the body panel, thereby preventing the ground-side terminal 32 from rotating together with the fixing bolt.

Figure 3:
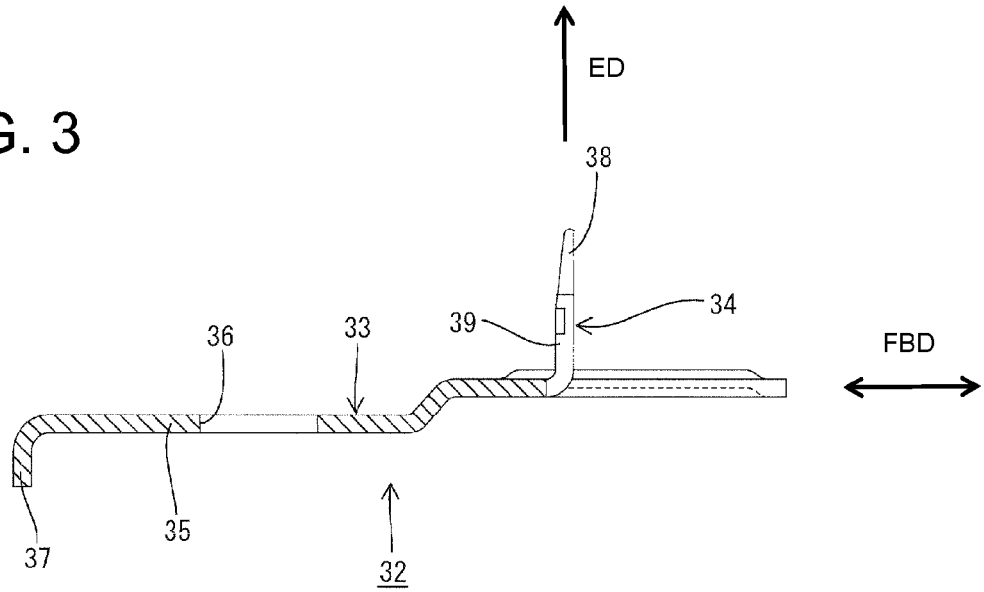
FIG. 3 is a section along III-III of FIG. 1.

The capacitor mounting portion 34 is angled, preferably substantially perpendicularly to the plate surface of the terminal main body 33, as shown in FIGS. 3 and 7, by upwardly bending an piece extending forward from an intermediate position in forward and backward directions FBD. The capacitor mounting portion 34 includes a connecting head 38 to be connected electrically conductively to the ground-side electrode 21B of the capacitor 20 by soldering and a neck 39 below the connecting head 38.

As shown in FIGS. 2 and 3, the connecting head 38 is a substantially elliptical or round flat plate. The tip of a soldering iron can be brought into contact with the rear of the connecting head 38 to heat the connecting head 38 and press the solder H against a part connecting the front surface of the connecting head 38 and the ground-side electrode 21B of the capacitor 20. Thus, the solder H is melted for soldering to electrically conductively connect the connecting head 38 to the ground-side electrode 21B.

The neck 39 is a substantially rectangular column extending in an extending direction ED substantially vertically and substantially perpendicular to the plate surface of the terminal main body 33 and unitarily joins the terminal main body 33 and the connecting head 38.

As shown in FIG. 7, the housing 50 is substantially in the form of a box having open front and rear ends, and at least one partition wall 51 is provided in an intermediate part of the housing 50 in forward and backward directions FBD.

The mating connector can fit into a space of the housing 50 before the partition wall 51 and a space of the housing 50 behind or on the substantially opposite side of the partition wall defines a capacitor accommodating space 52 for accommodating the capacitor 20 connected to the wire-side terminal 31 and the ground-side terminal 32.

The capacitor 20 connected to the wire-side terminal 31 and the ground-side terminal 32 is inserted into this capacitor accommodating space 52 through the rear end opening of the housing 50. When the capacitor 20 is inserted to a proper position, the tabs 31A are held in the partition wall 51 while penetrating through the partition wall 51 in forward and backward directions FBD, as shown in FIG. 7.

After the capacitor 20 connected to the wire-side terminal 31 and the ground-side terminal 32 is inserted to the proper position into the capacitor accommodating space 52, the housing 50 is oriented so that the capacitor accommodating space 52 is open up and a molding agent such as molten epoxy resin is filled up to a position substantially flush with the rear end surface of the housing 50. In this way, the part where the wire-side electrode 21A and the wire-side terminal 31 are connected by soldering and the part where the ground-side electrode 21B and the ground-side terminal 32 are connected by soldering are covered integrally by the molded portion 53 obtained by curing the molding agent (epoxy resin).

The connecting head 38 of the capacitor mounting portion 34 of the ground-side terminal 32 is considerably wider than the neck 39 in the lateral direction LD, as shown in FIG. 2, by having the rear surface thereof hammered, recessed or stamped. Thus, the front surface to be connected to the ground-side electrode 21B of the capacitor 20 is larger in the lateral direction than the front surface of the neck 39. In other words, the cross-sectional area of the neck 39 is smaller than that of the connecting head 38 (when cut in a plane perpendicular to the extending direction ED). The front surface of the connecting head 38 is substantially flat as shown in FIGS. 5 and 7 and can be brought into substantially surface contact with the ground-side electrode 21B of the capacitor 20. Further, the connecting head 38 is gradually thinner from the lower end toward the upper end or in the extending direction ED, and the rear surface of the connecting head 38 is inclined forward. Further, an outer peripheral edge of the rear surface of the connecting head 38 is hammered to be rounded over substantially the entire circumference.

Figure 4:
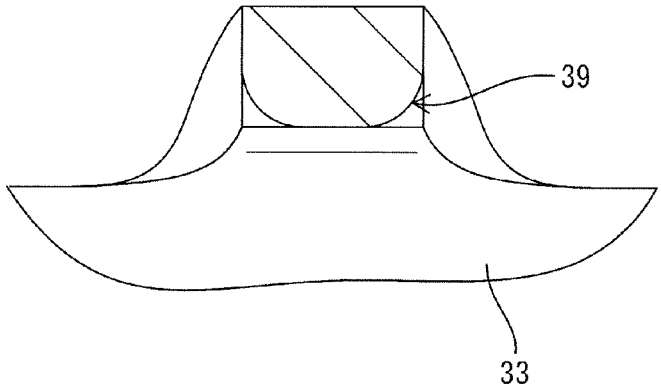
FIG. 4 is an enlarged section of an essential part cut along IV-IV of FIG. 2.

The neck 39 of the capacitor mounting portion 34 is constricted relative to the connecting head 38 and is narrower than the connecting head 38, as shown in FIG. 2. Further, the neck 39 is resiliently deformable in forward and backward directions FBD and lateral direction LD. A substantially central part of the neck 39 in the vertical or extending direction ED is hammered at rear corners on both lateral sides to have a substantially flat semicircular cross section, as shown in FIG. 4. Thus, an intermediate part of the neck 39 in the vertical or extending direction ED is narrower than upper and lower end parts of the neck 39. That is, as shown in FIG. 1, the cross-sectional area of the neck 39 is less (about half or less) than that of the lower part of the connecting head 38. Further, the front surface of the neck 39 is formed to be flush with the front surface of the connecting head 38 (surface to be connected to the ground-side electrode 21B of the capacitor 20).

To connect the connecting head 38 of the ground-side terminal 32 to the ground-side electrode 21B of the capacitor 20, the tip of the soldering iron is brought into contact with the rear surface of the connecting head 38 to heat the connecting head 38 with the ground-side electrode 21B of the capacitor 20 held in contact with the front surface of the connecting head 38. Subsequently, the solder H is pressed against a part where the front surface of the connecting head 38 and the ground-side electrode 21B are connected to melt the solder H for soldering. Thus, the connecting head 38 and the ground-side electrode 21*b* are connected electrically conductively. At this time, unless the front surface of the connecting head 38 (surface to be connected to the ground-side electrode 21B of the capacitor 20) is heated sufficiently, the solder H is not melted completely and voids are formed in the solder, since the lead-free solder H has a higher melting point than leaded solder. Further, since the ground-side terminal 32 is made of a material (e.g. steel plate) having lower thermal conductivity than the wire-side terminal 31 (e.g. of copper or copper alloy), a time to heat the front surface of the connecting head 38 tends to become longer as compared with the wire-side terminal 31.

In such a case, the formation of voids may be suppressed by extending a heating time for the connecting head 38 by the soldering iron and completely melting the solder H. However, if the heating time for the connecting head 38 is extended, the ground-side electrode 21B of the capacitor 20 also is heated for a longer time and the capacitor 20 may be damaged by heat.

Accordingly, the connecting head 38 is hammered to be thinner than before it is hammered. According to Fourier's law, the quantity of heat $\Delta Q$ [J] moving in a section ($L \times A$ [m3]) having a thickness L [m] and a cross-sectional area A [m2] can be expressed by $\Delta Q=(k \times A \times \Delta T \times t)$ when k [W/mk], $\Delta t$ [K] and t [s] denote thermal conductivity, temperature difference and time. By reducing the thickness L, the quantity of heat $\Delta Q$ moving in an object can be increased. Accordingly, the quantity of heat transferred in the connecting head 38 becomes larger than before the connecting head 38 is hammered, so that the temperature of the front surface of the connecting head 38, which to be connected to the ground-side electrode 21B of the capacitor 20, can be increased in a short time.

Further, by making the neck 39 narrower than the connecting head 38, the cross-sectional area of the neck 39 is formed to be less (about half or less) than that of the lower end part of the connecting head 38. According to Fourier's law described above, the quantity of heat $\Delta Q$ moving in an object can be reduced by reducing the cross-sectional area A. Thus, the quantity of heat transferring in the neck 39 can be reduced e.g. to about half as compared with the case where the cross-sectional area of the neck 39 is the same as the lower end part of the connecting head 38. Therefore radiation of the heat of the connecting head 38 to the terminal main body 33 via the neck 39 can be reduced. Since the connecting head 38 can be heated sufficiently without extending the heating time for the connecting head 38 and the escape of the heat of the connecting head 38 to the terminal main body 33 via the neck 39 can be reduced, the ground-side electrode 21B and the connecting head 38 can be soldered by sufficiently melting the solder H without forming voids in the solder H. That is, connection reliability between the capacitor 20 and the ground-side electrode 32 can be ensured without damaging the capacitor 20 by heat and overall operability and connection effectiveness are improved.

The intermediate part of the neck 39 in the vertical direction (extending direction ED) is made even narrower than the upper and lower end parts. Thus, radiation of the heat of the connecting head 38 to the terminal main body 33 via the neck 39 can be reduced further.

After the wire-side terminal 31 and the ground-side terminal 32 are connected to the capacitor 20, the capacitor 20 connected to the wire-side terminal 31 and the ground-side terminal 32 is inserted to the proper position into the capacitor accommodating space 52 of the housing 50. Then, the housing 50 is oriented so that the capacitor accommodating space 52 is open up, and molten molding agent (such as epoxy resin) is filled up to the position substantially flush with the rear end surface of the housing 50 and of the capacitor 20 to integrally cover the parts where the both electrodes 21A, 21B and the wire-side terminal 31 and the ground-side terminal 32 are connected by soldering by the molded portion 53 to complete the connector 10.

In this process, the molding agent (particularly the molten epoxy resin) is thermally shrunk when being cured and stress associated with thermal shrinkage concentrates on the connecting head 38 and the ground-side electrode 21B. Thus, the solder H may be cracked or broken. However, the neck 39 can be deformed resiliently according to thermal shrinkage deformation of the molding agent (epoxy resin). Thus, it is possible to suppress the concentration of stress on the solder H and the formation of a crack, a split or the like in the solder H.

If the connector 10 is subjected to a test in which heating and cooling are performed, such as a heat shock test, stress associated with the deformation of the molded portion 53 concentrates on the connecting head 38 and the ground-side electrode 21B due to a difference in linear expansion coefficient between metal and resin as when a potting material is cured and shrunk. Also in this case, the neck 39 is deformed resiliently according to the deformation of the molded portion 53, thereby suppressing concentration of stress on the solder H and the formation of a crack, a split or the like in the solder H.

As described above, when the tip of the soldering iron is brought into contact with the rear surface of the connecting head 38 to heat the connecting head 38 and the connecting head 38 and the ground-side electrode 21B are connected by soldering, the connecting head 38 can be heated sufficiently without extending the heating time for the connecting head 38 and the escape of the heat of the connecting head 38 to the terminal main body 33 via the neck 39 can be reduced. In this way, the solder H can be melted sufficiently, the ground-side electrode 21B and the connecting head 38 can be soldered without forming voids in the solder H, and connection reliability between the capacitor 20 and the ground-side terminal 32 can be ensured without damaging the capacitor 20 by heat. Further, although stress concentrates on the solder H connecting the connecting head 38 and the ground-side electrode 21B by thermal expansion and shrinkage of the molded portion 53, the neck 39 can be deformed resiliently according to the deformation of the molded portion 53 so that the formation of a crack, a split or the like in the solder H can be suppressed.

Further, since the surface (front surface) of the connecting head 38 to be connected to the ground-side electrode 21B of the capacitor 20 is formed to be larger in the lateral direction LD than the front surface of the neck 39 and the front surface of the connecting head 38 is formed to be flat by hammering the rear surface of the connecting head 38, the ground-side electrode 21B and the connecting head 38 can be connected more reliably and connection reliability between the electrode and the connecting head can be more reliable.

The connecting head 38 is substantially in the form of a round flat plate. Thus, a force received from the molded portion 53 by the connecting head 38 (force trying to resiliently deform the connecting head 38) such as in a heat shock test can be distributed over the entire connecting head without being concentrated on a specific position. Thus, the formation of a crack, a split or the like in the solder H attached to the connecting head can be suppressed as compared with the case where the connecting head is formed to have a rectangular shape including corners.

Further, the connecting head 38 tends to be heated for a long time since the ground-side terminal 32 made of steel plate has lower thermal conductivity than copper. However, the connecting head 38 can be heated sufficiently without extending the heating time for the connecting head 38 and the escape of the heat of the connecting head 38 to the terminal main body 33 via the neck 39 can be reduced as compared with the connecting head 38 just cut out from the base material. Thus, the solder H is melted sufficiently, which is effective in soldering the ground-side electrode 21B and the connecting head 38.

The invention is not limited to the above described embodiment. For example, the following embodiments are also included in the scope of the invention.

Although the capacitor 20 is illustrated as an electronic device in the above embodiment, the invention is not limited to such a mode and can also be applied, for example, to a resistor, a diode, a transistor or the like.

Although the ground-side terminal 32 includes the connector mounting portion 34 in the above embodiment, the invention is not limited to such a mode. For example, the wire-side terminal 31 may include the connector mounting portion 34.

The molded part 53 is formed by filling the molding agent (particularly the epoxy resin) after the capacitor 20 connected to the wire-side terminal 31 and the ground-side terminal 32 is inserted into the capacitor accommodating space 52 in the above embodiment. However, the molded portion 53 and the housing 50 may be integrally formed by insert molding using the capacitor 20 connected to the wire-side terminal 31 and the ground-side terminal 32 as an insert.

Although the ground-side terminal 32 is formed by press-working the SPC steel plate in the above embodiment, the invention is not so limited. For example, the ground-side terminal 32 may be formed by press-working a copper or copper alloy plate.

What is claimed is:

1. A connector in which a terminal fitting is formed by a base material and an electronic device connected to the terminal fitting is accommodated in a housing, comprising:

a connecting head on the terminal fitting and being thinner than the base material, the connecting head being connected to an electrode provided on the electronic device by soldering;

at least one neck provided on the terminal fitting and being narrower than the connecting head, the neck being resiliently deformable and extending from the connecting portion; and a molded portion in the housing to integrally at least partly cover the electrode of the electronic device and the connecting head of the terminal fitting.

2. The connector of claim 1, wherein the terminal fitting is formed by press-working a metal base material substantially in the form of a flat plate.

3. The connector of claim 1, wherein the connecting head is such that a surface to be connected to the electrode of the electronic device is hammered to be larger than before it is hammered.

4. The connector of claim 1, wherein the connecting head substantially is in the form of a round flat plate.

5. The connector of claim 1, wherein:

the electronic device comprises a capacitor;

the terminal fitting includes a ground-side terminal made of iron and having a first end connected to a grounding part and a second end connected to the capacitor; and the connecting head is formed on the ground-side terminal.

6. The connector of claim 1, wherein a cross-sectional area of the neck is smaller than that of the connecting head.

7. The connector of claim 1, wherein the connecting head is formed to be gradually thinner in an extending direction thereof, and wherein a surface of the connecting head substantially opposite to a connecting surface thereof to the electrode is inclined toward the connecting surface.

8. The connector of claim 7, wherein a substantially central part of the neck in the extending direction is hammered at rear corners located on both lateral sides, thereby particularly substantially having a flat semicircular cross section.

9. The connector of claim 7, wherein an intermediate part of the neck in the extending direction is made further narrower than upper and/or lower end parts of the neck.

10. The connector of claim 1, wherein a cross-sectional area of the neck is set to be about half or less than that of a lower end part of the connecting head.

11. The connector of claim 5, wherein a connecting surface of the connecting portion to be connected to the electrode of the capacitor is formed to be substantially flush with a corresponding surface of the neck.

* * * * *